US010283870B2

(12) United States Patent
Nishizono et al.

(10) Patent No.: US 10,283,870 B2
(45) Date of Patent: May 7, 2019

(54) TUNABLE ANTENNA

(71) Applicant: Kyocera Corporation, Kyoto-shi, Kyoto (JP)

(72) Inventors: Mitsuhiro Nishizono, Hachioji (JP); Daisuke Togashi, Yokohama (JP); Kouhei Sugawara, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 125 days.

(21) Appl. No.: 15/163,671

(22) Filed: May 25, 2016

(65) Prior Publication Data

US 2016/0352017 A1 Dec. 1, 2016

(30) Foreign Application Priority Data

May 26, 2015 (JP) ..... 2015-106461

(51) Int. Cl.

| | |
|---|---|
| ***H01Q 9/30*** | (2006.01) |
| ***H01Q 9/32*** | (2006.01) |
| ***H01Q 5/328*** | (2015.01) |
| ***H01Q 5/357*** | (2015.01) |

(52) U.S. Cl.

CPC ..... *H01Q 9/32* (2013.01); *H01Q 5/328* (2015.01); *H01Q 5/357* (2015.01)

(58) Field of Classification Search

CPC ..... H01Q 9/0442; H01Q 9/32; H01Q 9/40; H01Q 5/30; H01Q 5/314; H01Q 5/328

See application file for complete search history.

(56) References Cited

U.S. PATENT DOCUMENTS

| | | | | |
|---|---|---|---|---|
| 7,079,079 | B2 * | 7/2006 | Jo | H01Q 1/243 343/700 MS |
| 7,420,511 | B2 | 9/2008 | Oshiyama et al. | |
| 9,548,535 | B1 * | 1/2017 | Kuo | H01Q 3/34 |
| 2006/0097918 | A1 | 5/2006 | Oshiyama et al. | |
| 2007/0176836 | A1 * | 8/2007 | Abramov | H01Q 1/2291 343/702 |

(Continued)

FOREIGN PATENT DOCUMENTS

| | | | |
|---|---|---|---|
| JP | 2000-114860 | A | 4/2000 |
| JP | 2001-136019 | A | 5/2001 |

(Continued)

OTHER PUBLICATIONS

Office Action in JP Application No. 2015-106461, dated Feb. 7, 2017, for which an explanation of relevance is attached.

*Primary Examiner* — Dameon E Levi
*Assistant Examiner* — Hasan Z Islam
(74) *Attorney, Agent, or Firm* — Hauptman Ham, LLP

(57) ABSTRACT

A tunable antenna includes an antenna element having a feed point at one end thereof, a feed line being connected to the feed point, and a switcher that switches the resonance frequency of the antenna element. The switcher is connected to the antenna element at a position that is at a distance other than $(\lambda_m/4)\times n$ from the one end towards another end of the antenna element, where $\lambda_m$ represents the wavelength corresponding to any resonance frequency of the antenna element, and n is a positive, odd number.

1 Claim, 9 Drawing Sheets

(56) References Cited

U.S. PATENT DOCUMENTS

| | | | | |
|---|---|---|---|---|
| 2011/0183633 | A1* | 7/2011 | Ohba | H01Q 1/243<br>455/77 |
| 2011/0234469 | A1* | 9/2011 | Shoji | H01Q 21/28<br>343/852 |
| 2012/0007785 | A1* | 1/2012 | Amari | H01O 9/0407<br>343/722 |
| 2012/0127055 | A1* | 5/2012 | Yamagajo | H01Q 1/243<br>343/850 |
| 2013/0169490 | A1* | 7/2013 | Pascolini | H01Q 1/243<br>343/702 |

FOREIGN PATENT DOCUMENTS

| | | | |
|---|---|---|---|
| JP | 2010-21838 | A | 1/2010 |
| WO | 2004/047223 | A1 | 6/2004 |

* cited by examiner

TUNABLE ANTENNA

CROSS REFERENCE TO RELATED APPLICATION

This application claims priority to and the benefit of Japanese Patent Application No. 2015-106461 (filed on May 26, 2015), the entire contents of which are incorporated herein by reference.

TECHNICAL FIELD

This disclosure relates to a tunable antenna.

BACKGROUND

In recent years, the frequency band that an antenna needs to cover has expanded as a result of faster, higher-capacity radio communication, in particular on mobile terminals and the like. Therefore, in order to implement an antenna that supports numerous frequency bands, a tunable antenna that can switch the resonance frequency has been developed by providing electronic components, such as switches and tunable capacitors, inside a matching circuit connected between the antenna element and the feed.

Tunable antennas that vary the actual antenna element length by providing electronic components such as switches and tunable capacitors in the antenna element have also been proposed. With such a tunable antenna, by changing the reactance component of the antenna element, the resonance frequency can be switched dynamically as compared to a structure in which electronic components are disposed inside the matching circuit.

SUMMARY

A tunable antenna according to this disclosure includes:

an antenna element including a feed point at one end thereof, a feed line being connected to the feed point; and a switcher configured to switch a resonance frequency of the antenna element;

such that the switcher is connected to the antenna element at a position that is at a distance other than $(\lambda_m/4)\times n$ from the one end towards another end of the antenna element, where $\lambda_m$ represents a wavelength corresponding to any resonance frequency of the antenna element, and n is a positive, odd number.

A tunable antenna according to this disclosure includes:

an antenna element including a feed point at one end thereof, a feed line being connected to the feed point;

a switcher configured to switch a resonance frequency of the antenna element; and a phase rotator connected between the antenna element and the switcher and configured to shift a phase of voltage applied to the switcher.

A tunable antenna according to this disclosure includes:

an antenna element including a feed point at one end thereof, a feed line being connected to the feed point;

a switcher configured to switch a resonance frequency of the antenna element; and a frequency selector connected between the antenna element and the switcher and configured to allow passage of a signal at a predetermined frequency.

A tunable antenna according to this disclosure includes:

an antenna element including a feed point at one end thereof, a feed line being connected to the feed point;

a switcher configured to switch a resonance frequency of the antenna element; and an impedance adjustor connected between the antenna element and the switcher and configured to lower an input impedance of the switcher.

DETAILED DESCRIPTION

With reference to the drawings, the following describes embodiments of this disclosure in detail.

Since a standing wave occurs in an antenna element, there exist locations where the voltage is maximized and minimized. Accordingly, in a tunable antenna in which the antenna element length is made variable by providing electronic components in the antenna element, a high voltage might be applied to the electronic components if the electronic components are disposed at a position where the voltage is high.

Therefore, as a tunable antenna in which the antenna element length is made variable by providing electronic components in the antenna element, it would be helpful to provide a tunable antenna that allows a reduction in application of high voltage to the electronic components.

Embodiment 1

Figure 1:
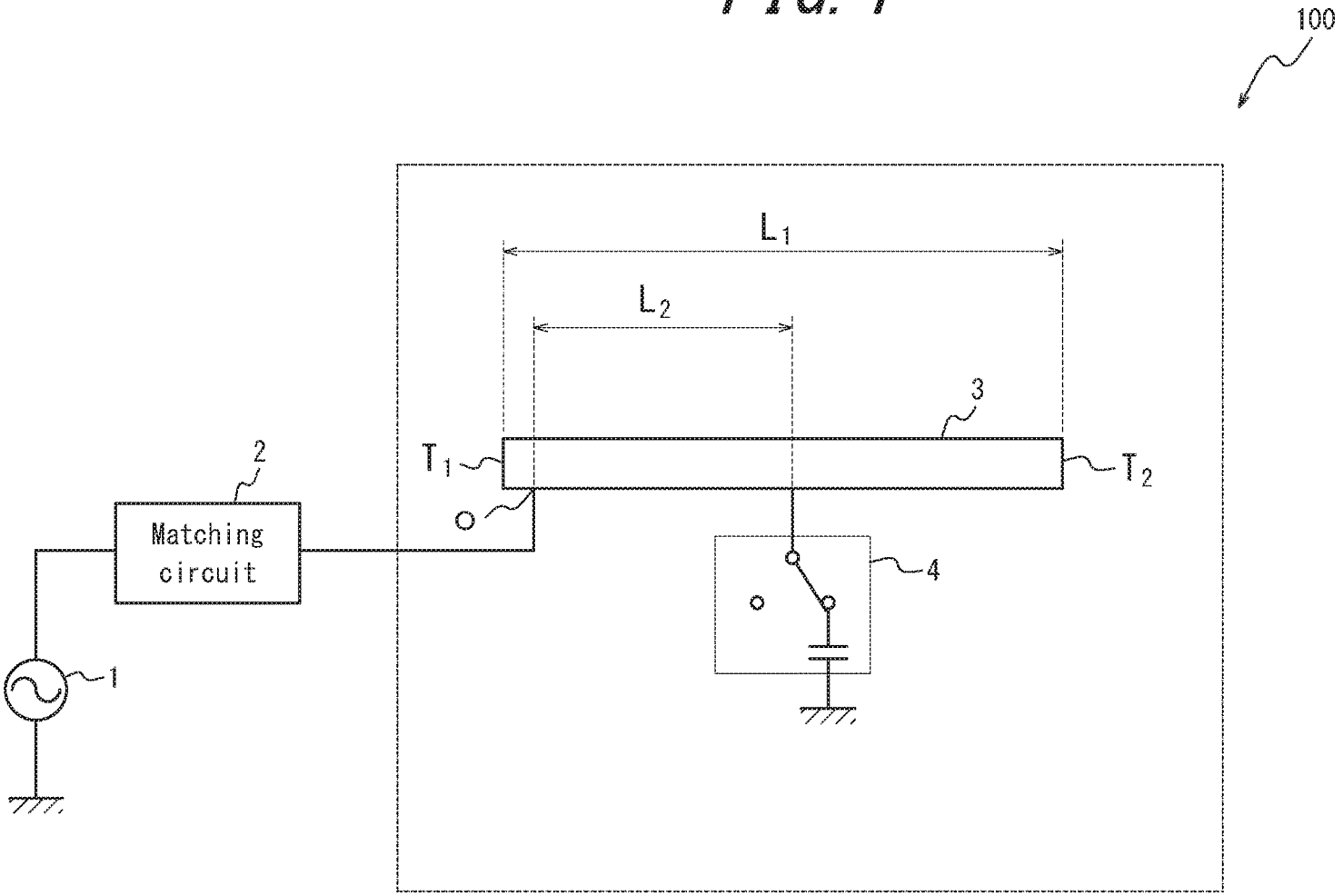
FIG. 1 schematically illustrates the structure of a tunable antenna according to Embodiment 1.

FIG. 1 schematically illustrates the structure of a tunable antenna 100 according to Embodiment 1. As illustrated in FIG. 1, the tunable antenna 100 includes an antenna element 3 and a switcher 4. A feed 1, a matching circuit 2, and the antenna element 3 are connected in this order via a feed line, and the switcher 4 is connected to the antenna element 3. The connection point between the antenna element 3 and the feed line is referred to as a feed point O. The tunable antenna 100, feed 1, and matching circuit 2 constitute a portion of an electronic device (not illustrated).

The feed 1 feeds a signal for generating a radio wave of a predetermined frequency to the matching circuit 2. The feeding method of the feed 1 is current feeding, configured so that the current is maximized and the voltage is minimized at the feed point O.

The matching circuit 2 adjusts the impedance so as to reduce the energy loss between the feed 1 and the antenna element 3. By adjusting the impedance of the matching circuit 2, the frequency (resonance frequency or matching frequency) of the radio wave transmitted and received via the antenna element 3 can be adjusted to some degree. The matching circuit 2 is, for example, mounted on a printed board such as a Printed Circuit Board (PCB) or a Flexible Printed Circuit (FPC) and is connected to the antenna element 3.

The antenna element 3 is, for example, a monopole antenna that includes the feed point O where the feed line is connected near one end $T_1$ of the antenna element 3. The antenna element 3 may be configured with sheet metal or may be an element printed on a case. The length $L_1$ from one end $T_1$ to the other end $T_2$ of the antenna element 3 is equivalent to a positive, odd multiple of one fourth the length ($\lambda_1/4$) of the fundamental wavelength $\lambda_1$ corresponding to a certain fundamental frequency f1.

The switcher 4 is an electronic component for switching the resonance frequency by switching the reactance component of the antenna element 3 and is configured with a switch, a variable element such as a tunable capacitor, or a combination thereof. The switcher 4 is connected at a position that is a distance $L_2$ from one end $T_1$ of the antenna element 3 towards the other end $T_2$. Details on the distance $L_2$ are provided below. The resonance frequency is assumed to be switched for example among the 700 MHz band, 800 MHz band, and 900 MHz band in the Low Band but may also be switched to the 2 GHz band in the Mid Band, the 2.5 GHz band in the High Band, and the like. The switcher 4 is, for example, mounted on a printed board such as a PCB or FPC and is connected to the antenna element 3.

Figure 2A:
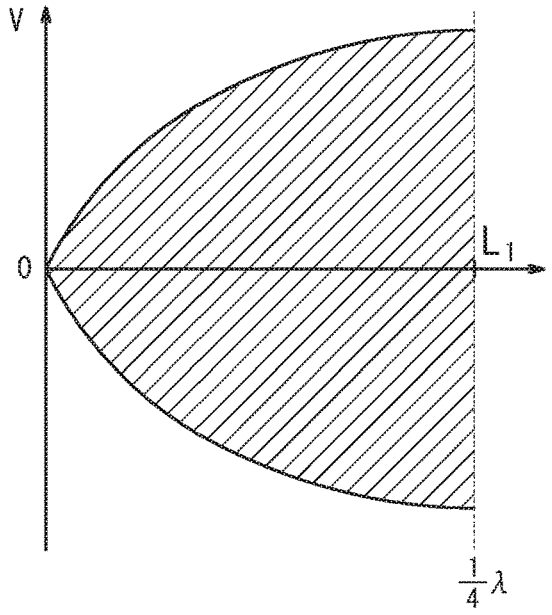
FIGS. 2A and 2B conceptually illustrate the voltage distribution on the antenna element in accordance with the wavelength of a standing wave.
Figure 2B:
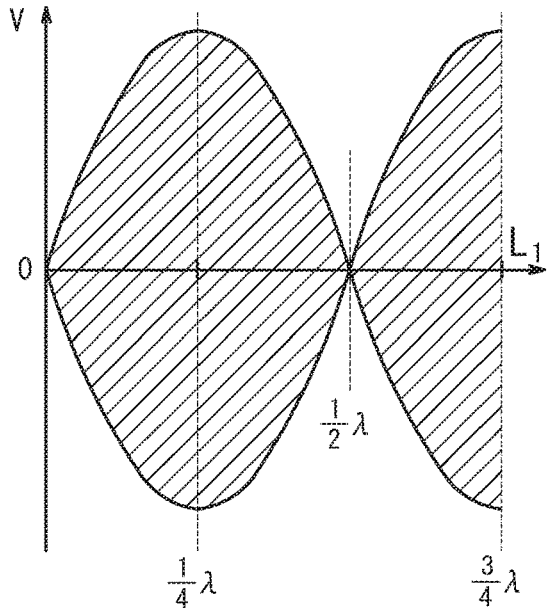

FIGS. 2A and 2B conceptually illustrate the voltage distribution on the antenna element 3 in accordance with the relationship between the length $L_1$ of the antenna element 3 and the fundamental wavelength $\lambda_1$. Specifically, FIGS. 2A and 2B respectively illustrate the voltage distribution on the antenna element 3 when $L_1=\lambda_1/4$ and when $L_1=3\lambda_1/4$. In these figures, the horizontal axis represents the distance from one end $T_1$ (0) of the antenna element 3 towards the other end $T_2$, and the vertical axis represents the voltage V. As illustrated in FIGS. 2A and 2B, when $L_1=\lambda_1/4$, the voltage distribution is a standing wave in which a node occurs at one end $T_1$ (0), which is the feed point O, and an antinode occurs at the other end $T_2$ ($\lambda_1/4$), whereas when $L_1=3\lambda_1/4$, the voltage distribution is a standing wave in which nodes occur at one end $T_1$ (0), which is the feed point O, and at $\lambda_1/2$, and antinodes occur at $\lambda_1/4$ and at the other end $T_2$ ($3\lambda_1/4$). In this way, the voltage on the antenna element 3 becomes a standing wave in which an antinode occurs when the distance from one end $T_1$ to the other end $T_2$ is $(\lambda_1/4)\times n$ (where n is a positive, odd number; the same holds below).

Maximum voltage occurs at locations where the voltage distribution on the antenna element 3 is the antinode of a standing wave. Therefore, in this embodiment, the switcher 4 is connected at a position other than the antinodes of the voltage distribution on the antenna element 3. In other words, the distance $L_2$ from one end $T_1$ of the antenna element 3 towards the other end $T_2$, i.e. the position where the switcher 4 is connected, is a value other than $(\lambda_1/4)\times n$. The voltage on the antenna element 3 can take the form of a standing wave with an antinode when the distance from one end $T_1$ towards the other end $T_2$ is $(\lambda_2/4)\times n$ or $(\lambda_3/4)\times n$, where the resonance frequencies that can be switched to by the switcher 4 are f2 and f3 and the corresponding wavelengths are $\lambda_2$ and $\lambda_3$. Accordingly, the distance $L_2$ is a value other than $(\lambda_m/4)\times n$ (where m is 1, 2, or 3). The resonance frequencies that can be switched to by the switcher 4 are not limited to two types. The number of types may be one, or may be three or more.

The distance $L_2$ is preferably less than $\lambda_{min}/4$, where $\lambda_{min}$ represents the smallest wavelength among the wavelengths corresponding to all of the resonance frequencies of the antenna element 3. In this way, degradation in characteristics or destruction of the electronic components constituting the switcher 4 can more reliably be prevented at all of the desired frequencies.

Figure 3:
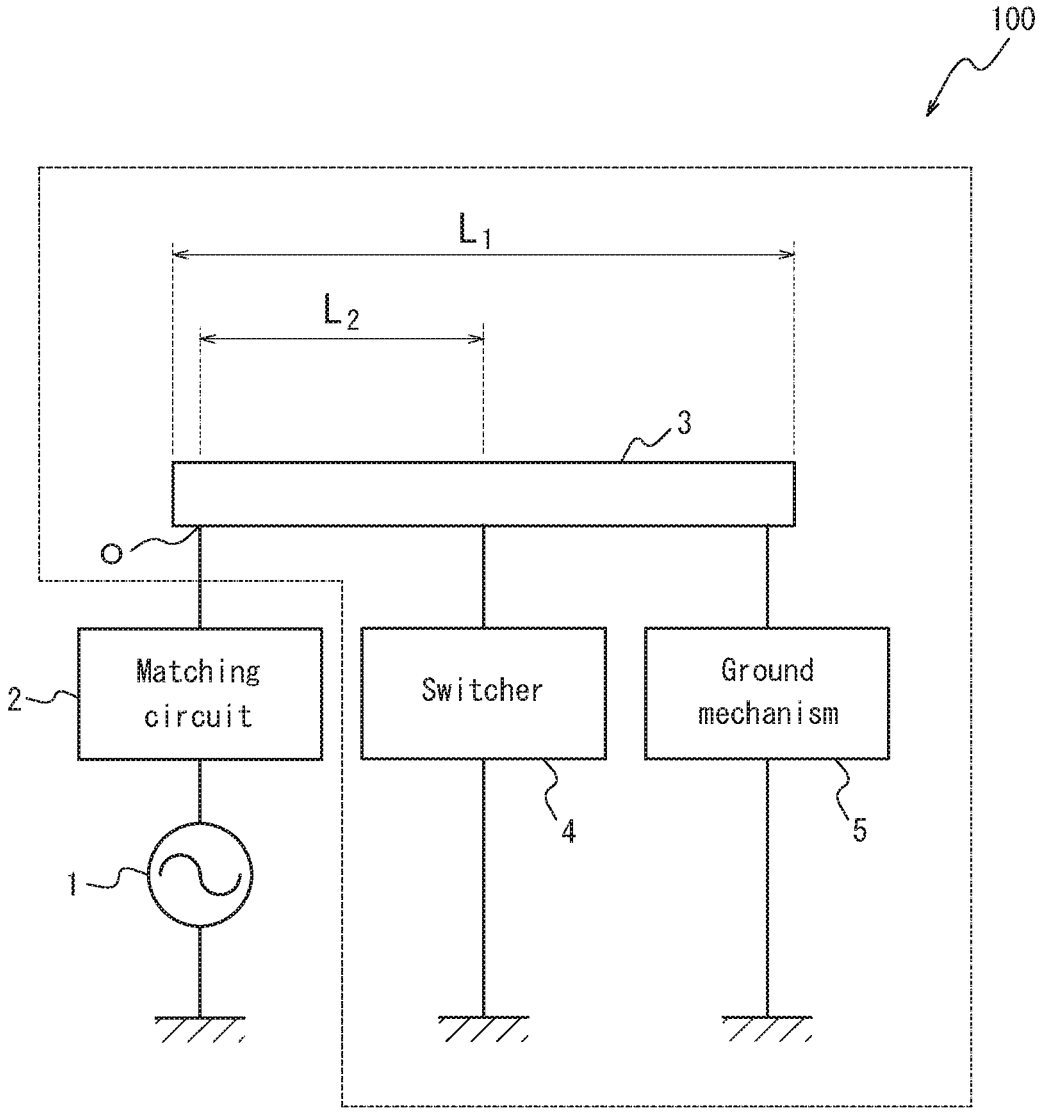
FIG. 3 schematically illustrates the structure of a tunable antenna according to a modification to Embodiment 1.

When it is difficult to connect the switcher 4 at the desired position due to a mechanistic limitation or the like, a ground mechanism 5 may be connected to the other end $T_2$, as illustrated in FIG. 3. In this way, the amplitude of the voltage can be adjusted, thus easily allowing the distance $L_2$ to be set to less than $\lambda_{min}/4$. The ground mechanism 5 may be directly connected to the GND or may be connected to the GND via an inductor, capacitor, resistor, or the like.

When $L_1=\lambda_{max}/4$, where the largest wavelength among the wavelengths $\lambda_1$, $\lambda_2$, and $\lambda_3$ is $\lambda_{max}$, the ground mechanism 5 is preferably disposed at a position that is $\lambda_{max}/8$ or less and less than $\lambda_{min}/4$ from one end $T_1$ of the antenna element 3 towards the other end $T_2$.

In this way, in the tunable antenna 100 according to this embodiment, the switcher 4 is connected to the antenna element 3 at a position that is at a distance other than $(\lambda_m/4)\times n$ (where $\lambda_m$ represents the wavelength corresponding to any resonance frequency of the antenna element 3, and n is a positive, odd number) from one end $T_1$ of the antenna element 3 towards the other end $T_2$. In this way, a high voltage can be prevented from being applied to the switcher 4, thereby preventing degradation in characteristics or destruction of the electronic components constituting the switcher 4. Accordingly, a compact, high-performance tunable antenna 100 can be obtained.

Embodiment 2

Figure 4:
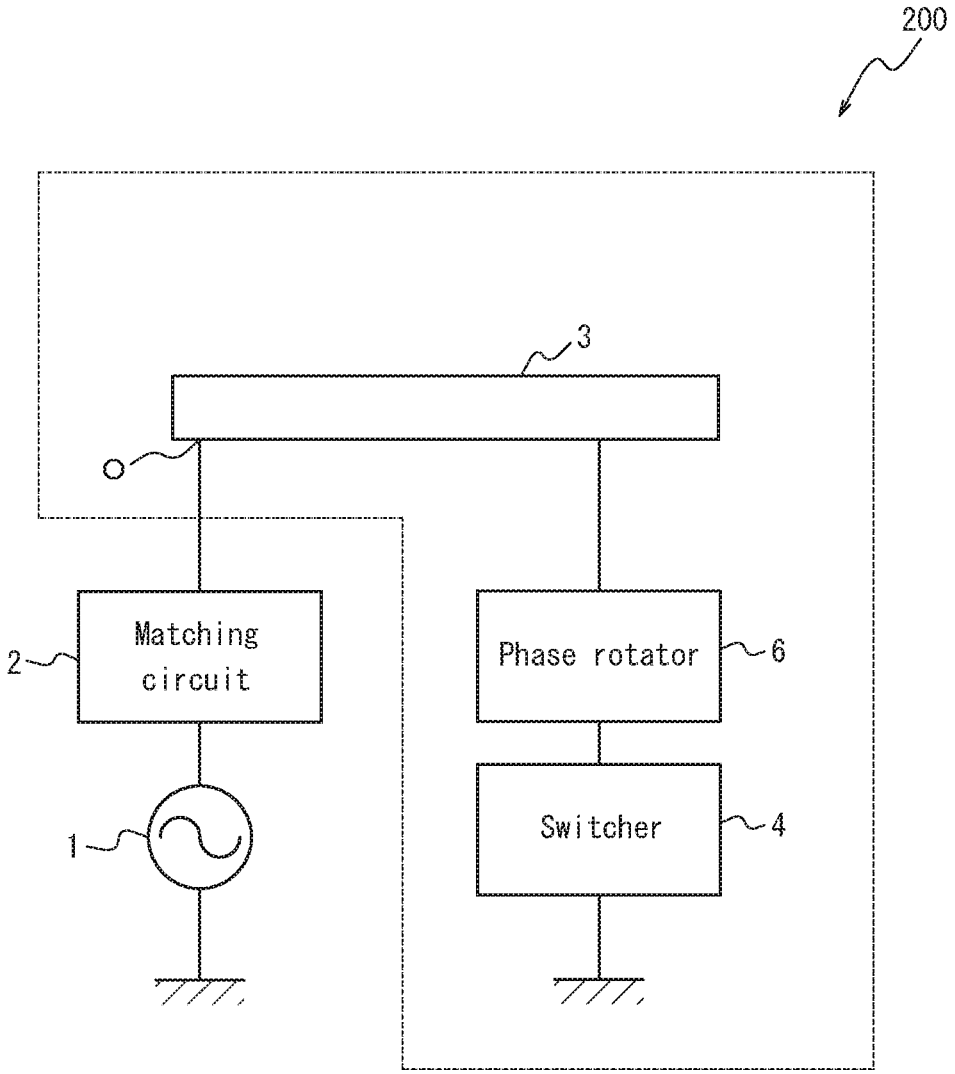
FIG. 4 schematically illustrates the structure of a tunable antenna according to Embodiment 2.

FIG. 4 schematically illustrates the structure of a tunable antenna 200 according to Embodiment 2. As illustrated in FIG. 4, the tunable antenna 200 has the same structure as that of the tunable antenna 100 in Embodiment 1, except that the distance $L_2$ is not limited, i.e. the position at which the switcher 4 is connected to the antenna element 3 is not limited, and that a phase rotator 6 is further included between the antenna element 3 and the switcher 4. A description of the same structure is therefore omitted.

Figure 5A:
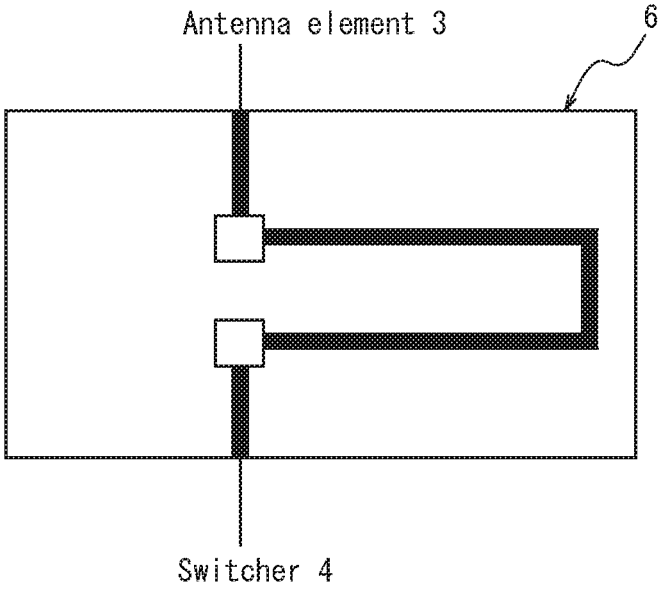
FIGS. 5A and 5B schematically illustrate the structure of a phase rotator in the tunable antenna according to Embodiment 2.

For example as illustrated in FIG. 5A, the phase rotator 6 may be configured by a pattern printed on a printed board, such as a PCB or FPC. The phase rotator 6 may also be formed by a matching circuit. The matching circuit may have a structure similar to that of the matching circuit 2. The value of $\omega$ is preferably $\pi/2\times n$, where $\omega$ is the phase of voltage shifted by the phase rotator 6. As a result, even if the location where the switcher 4 is connected to the antenna element 3 via the phase rotator 6 is a location where an antinode of the standing wave of the voltage distribution occurs, the phase of voltage is shifted by the phase rotator 6 to a location other than the antinode of the standing wave. Therefore, a high voltage can be prevented from being applied to the switcher 4.

Figure 5B:
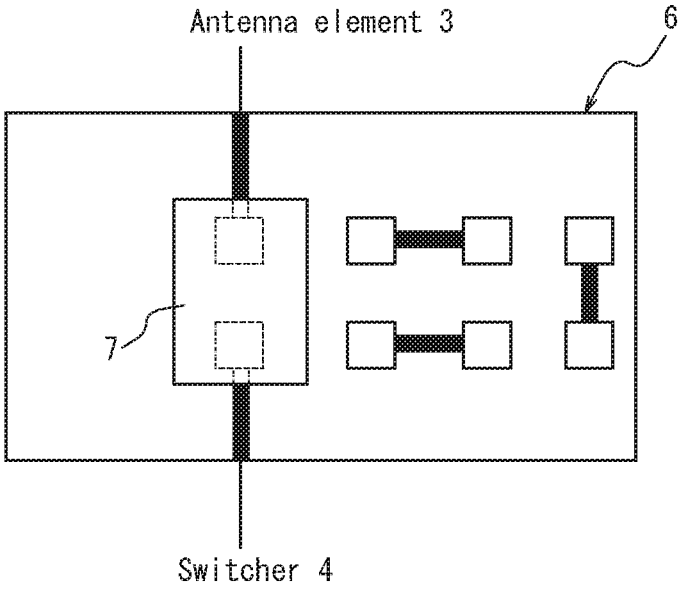

As illustrated in FIG. 5B, by further dividing up the pattern of the phase rotator 6 and connecting at a 0Ω jumper 7, the pattern length can easily be adjusted, preventing formation of an unnecessary stub. Furthermore, an inductor or capacitor may be used instead of the 0Ω jumper 7.

In this way, according to this embodiment, the tunable antenna 200 includes the phase rotator 6 between the antenna element 3 and the switcher 4, so that even if the switcher 4 is connected at a position on the antenna element 3 at which an antinode of a standing wave occurs in the voltage distribution, the phase of voltage is shifted by the addition of a path due to the phase rotator 6 connected therebetween. Therefore, a high voltage can be prevented from being applied to the switcher 4, thereby preventing degradation in characteristics or destruction of the electronic components constituting the switcher 4. Accordingly, a compact, high-performance tunable antenna 200 can be obtained.

Embodiment 3

Figure 6:
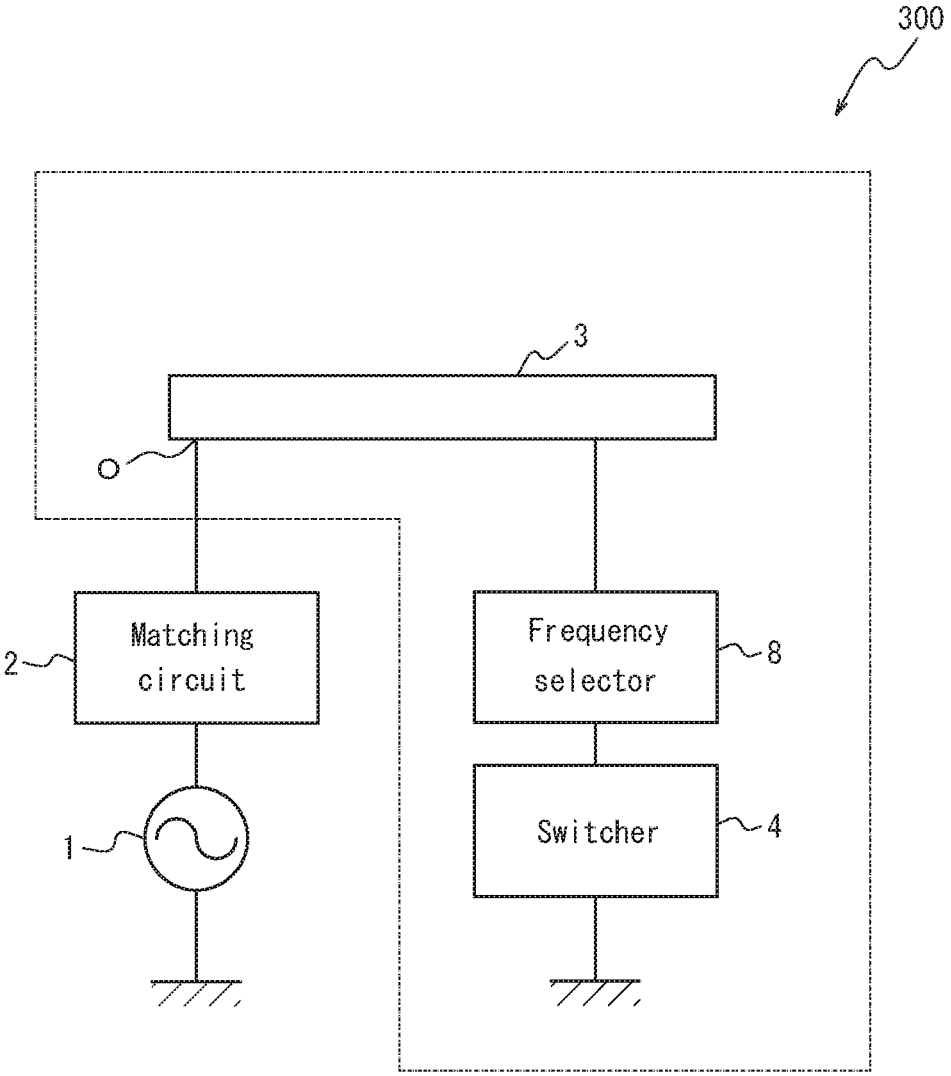
FIG. 6 schematically illustrates the structure of a tunable antenna according to Embodiment 3.

FIG. 6 schematically illustrates the structure of a tunable antenna 300 according to Embodiment 3. As illustrated in FIG. 6, the tunable antenna 300 has the same structure as that of the tunable antenna 200 in Embodiment 2, except that a frequency selector 8 is further included between the antenna element 3 and the switcher 4 instead of the phase rotator 6. A description of the same structure is therefore omitted.

Figure 7A:
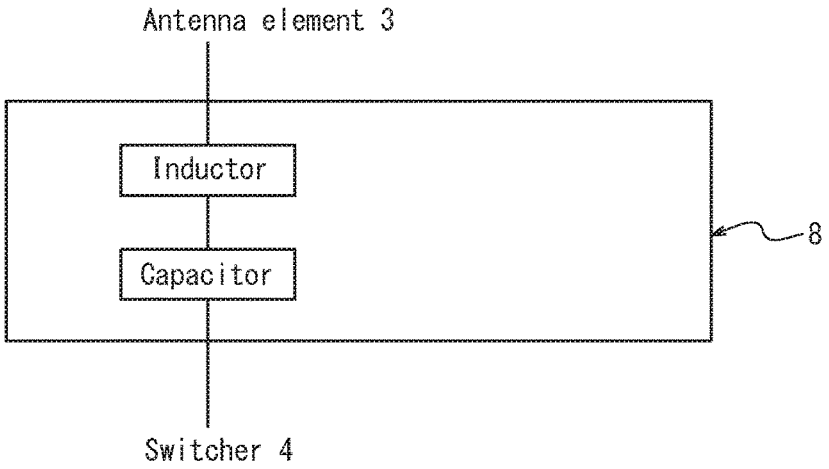
FIGS. 7A and 7B schematically illustrate the structure of a frequency selector in the tunable antenna according to Embodiment 3.

The frequency selector 8 has the function of allowing passage of a signal in a predetermined frequency band while blocking signals in other frequency bands. In this way, a high voltage can be prevented from being applied to the switcher 4 in an undesired frequency band. As illustrated in FIG. 7A, the frequency selector 8 may, for example, use series resonance formed by an inductor and a capacitor.

Figure 7B:
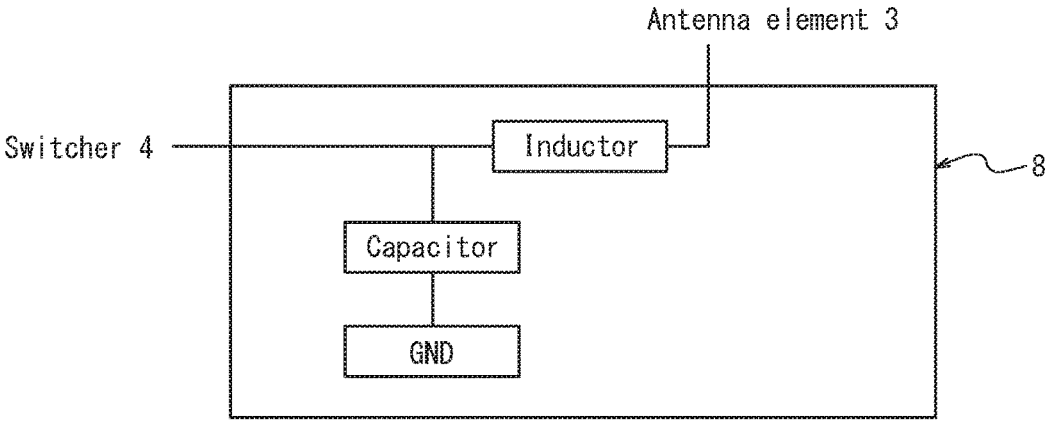

As illustrated in FIG. 7B, the frequency selector 8 may also be a low pass filter formed by a combination of elements. The frequency selector 8 may also have any other structure, such as a parallel resonance circuit or a high pass filter, as long as similar effects are obtained. Even when using the frequency selector 8, the effect of switching is not experienced and characteristics can be maintained for example in a frequency band unrelated to the frequency band switched to by the switcher 4.

The frequency selector 8 can also be used to achieve the function of a phase rotator. In other words, the phase of voltage can be shifted by the path that is added on as a result of including the frequency selector 8. As a result, application of a high voltage to the switcher 4 can be prevented.

In this way, according to this embodiment, the tunable antenna 300 includes the frequency selector 8 between the antenna element 3 and the switcher 4, thereby allowing passage of a signal in a desired frequency band while blocking signals in other frequency bands. Therefore, a high voltage can be prevented from being applied to the switcher 4 in an undesired frequency band, thereby preventing degradation in characteristics or destruction of the electronic components constituting the switcher 4. Accordingly, a compact, high-performance tunable antenna 300 can be obtained.

Embodiment 4

Figure 8:
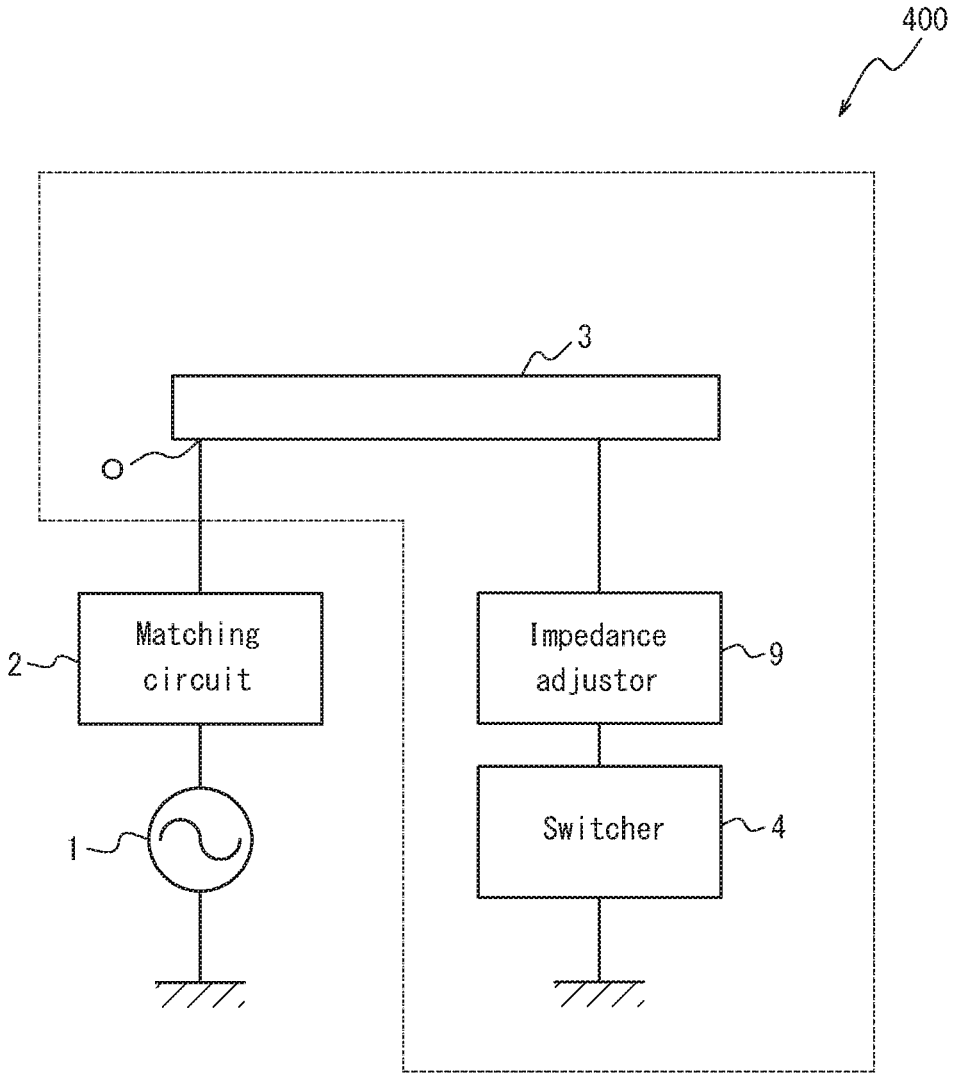
FIG. 8 schematically illustrates the structure of a tunable antenna according to Embodiment 4.

FIG. 8 schematically illustrates the structure of a tunable antenna 400 according to Embodiment 4. As illustrated in FIG. 8, the tunable antenna 400 has the same structure as that of the tunable antenna 200 in Embodiment 2, except that an impedance adjuster 9 is further included between the antenna element 3 and the switcher 4 instead of the phase rotator 6. A description of the same structure is therefore omitted.

Figure 9A:
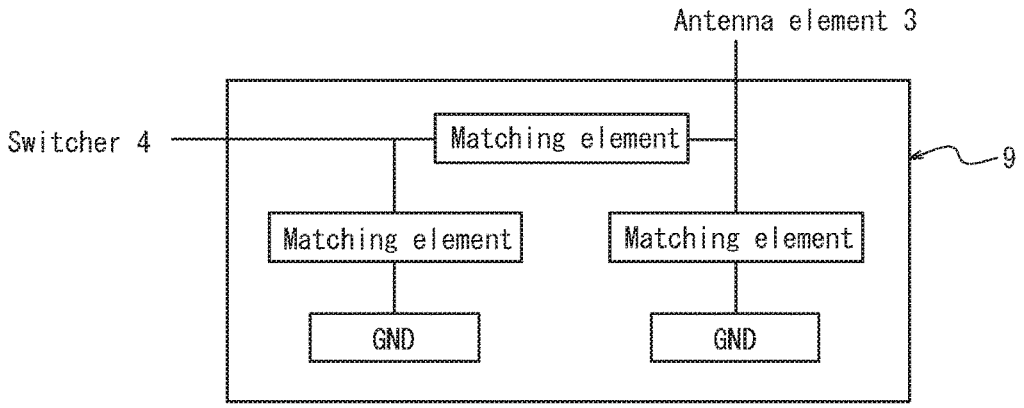
FIGS. 9A and 9B schematically illustrate the structure of an impedance adjustor in the tunable antenna according to Embodiment 4.
Figure 9B:
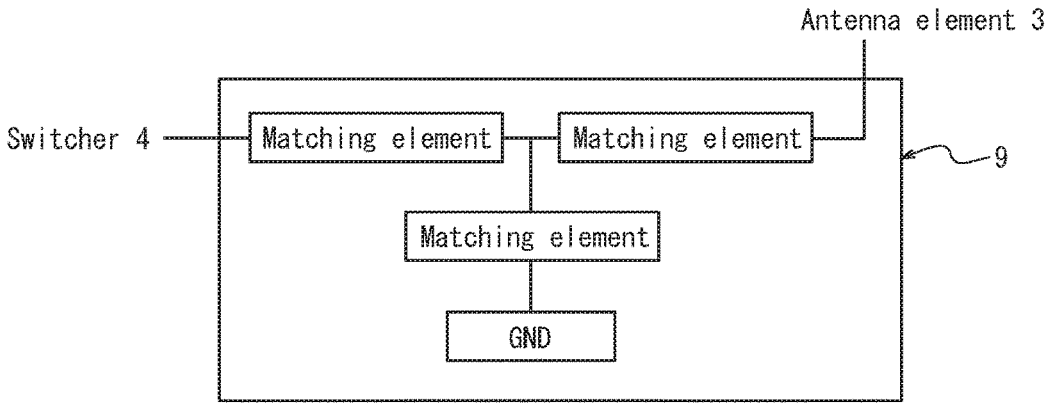

The impedance adjuster 9 is for adjusting the input impedance of the switcher 4 and may, for example, be formed by matching elements connected as illustrated in FIG. 9A (π-shaped) or connected as illustrated in FIG. 9B (T-shaped). The impedance adjuster 9 may also have any other structure as long as similar effects are obtained.

The voltage V applied to the switcher 4 satisfies the following equation, where R is impedance and P is power.

$$V^2=2RP \qquad \text{Equation 1}$$

As can be understood from Equation 1, the applied voltage is proportional to the square root of the impedance. Accordingly, by connecting the impedance adjuster 9 between the antenna element 3 and the switcher 4 and performing adjustment to lower the input impedance of the switcher 4, the voltage applied to the switcher 4 can be lowered.

In this way, according to this embodiment, the tunable antenna 400 includes the impedance adjuster 9 between the antenna element 3 and the switcher 4, thereby allowing reduction in the input impedance of the switcher 4. Therefore, a high voltage can be prevented from being applied to the switcher 4, thereby preventing degradation in characteristics or destruction of the electronic components constituting the switcher 4. Accordingly, a compact, high-performance tunable antenna 400 can be obtained.

In the disclosed tunable antenna in which the antenna element length is made variable by providing electronic components in the antenna element, the application of high voltage to the electronic components can be reduced.

The structures of the tunable antennas in some embodiments may be combined. For example, the designated connection position of the switcher 4 in Embodiment 1, the phase rotator 6 in Embodiment 2, the frequency selector 8 in Embodiment 3, and the impedance adjuster 9 in Embodiment 4 may be appropriately combined.

Although this disclosure is based on embodiments and the accompanying drawings, it is to be noted that various changes and modifications will be apparent to those skilled in the art based on this disclosure. Therefore, such changes and modifications are to be understood as included within the scope of this disclosure. For example, the functions and the like included in the various structural components may be reordered in any logically consistent way. Furthermore, structural components may be combined into one or divided.

The invention claimed is:

1. A tunable antenna, comprising:

an antenna element including a feed point at one end thereof, a feed line being connected to the feed point;

a switcher configured to switch a resonance frequency of the antenna element; and a ground mechanism connected to the antenna element, wherein the switcher is connected to the antenna element at a position that is at a distance other than $(\lambda_m/4)\times n$ from the one end towards another end of the antenna element, where $\lambda_m$ represents a wavelength corresponding to any resonance frequency of the antenna element, m is a natural number, and n is a positive, odd number, the switcher is connected to the antenna element at a position that is at a distance of less than $\lambda_{min}/4$ from the one end towards said another end of the antenna element, where $\lambda_{min}$ represents a smallest wavelength among wavelengths corresponding to all resonance frequencies of the antenna element, a length of the antenna element from the one end to said another end is $L_1=\lambda_{max}/4$, where $\lambda_{max}$ represents a largest wavelength among the wavelengths corresponding to all resonance frequencies of the antenna element, and the ground mechanism is connected to the antenna element at a position that is $\lambda_{max}/8$ or less and less than $\lambda_{min}/4$ from the one end towards said another end of the antenna element.

* * * * *